US006893020B1

(12) United States Patent
Snyder

(10) Patent No.: US 6,893,020 B1
(45) Date of Patent: May 17, 2005

(54) STACKABLE DOMINO GAME

(76) Inventor: Scott C. Snyder, 8560 Depot Rd., Lynden, WA (US) 98264

( * ) Notice: Subject to any disclaimer, the term of this patent is extended or adjusted under 35 U.S.C. 154(b) by 0 days.

(21) Appl. No.: 10/008,163

(22) Filed: Nov. 9, 2001

Related U.S. Application Data

(60) Provisional application No. 60/247,932, filed on Nov. 9, 2000.

(51) Int. Cl.[7] ..... A63F 3/00

(52) U.S. Cl. ..... 273/290; 273/287; 273/292

(58) Field of Search ..... 273/290, 292, 273/287, 288, 276, 236, 239, 241, 264, 271, 275, 282.3; 446/118, 124, 125, 85, 476; D21/391

(56) References Cited

U.S. PATENT DOCUMENTS 1,213,690 A * 1/1917 Quinones
1,894,605 A * 1/1933 Wright
1,978,107 A 10/1934 Hoffmann
1,998,526 A * 4/1935 Schubert
2,278,327 A * 3/1942 Magnus
2,883,764 A * 4/1959 Stephens
D215,103 S 9/1969 Stevens
3,546,792 A * 12/1970 Sherman
3,804,415 A 4/1974 Ryan
4,466,615 A 8/1984 Yaeger
4,552,363 A 11/1985 Rehkemper et al.
4,696,476 A * 9/1987 Eplett ..... 273/241
4,699,602 A * 10/1987 Giorgi ..... 273/157 R
6,186,856 B1 * 2/2001 Chen ..... 446/117

* cited by examiner

*Primary Examiner*—Vishu Mendiratta
(74) *Attorney, Agent, or Firm*—Todd N. Hathaway

(57) ABSTRACT

A stackable dominoes game having stepped, tile-shaped playing pieces. The playing pieces have upper and lower levels and at least three segments. The segments are marked with first and second indicia and the pieces are played by stacking them atop one another so that only segments having matching indicia are in vertical contact. The indicia may be patterns of dots, such as a one-dot pattern and a four-dot pattern. A game board is provided having a grid for aligning the playing pieces thereon. Fence pieces are provided for defining a confined area of the grid for playing the pieces therein, depending on the desired degree of difficulty. Additional pieces are provided for other aspects of play.

28 Claims, 11 Drawing Sheets

| number of players | grid size 4*4 | 5*5 | 6*6 | 7*7 | 8*8 |
|---|---|---|---|---|---|
| 2 | n | e | | | |
| 3 | h | n | e | | |
| 4 | th | n | e | | |
| 5 | th | h | n | e | |
| 6 | th | h | n | n | e |
| 7 | | th | h | n | e |
| 8 | | th | h | n | e |

e=easy ; n=normal
h=hard ; th=too hard

Starter Piece Chart

STACKABLE DOMINO GAME

This application claims the benefit of U.S. provisional application Ser. No. 60/247,933 filed Nov. 9, 2000.

BACKGROUND OF INVENTION a. Field of the Invention

The present invention relates generally to game apparatus, and, more particularly, to a board game apparatus in which there are stackable domino-like pieces having markings or other surface indicia that are to be matched in vertical register.

b. Related Art

Games in which players alternately place tiles or other playing pieces adjacent to previously played pieces in such a way that a correlated relationship is established exist in the prior art, a particular example of such a game being dominoes. In dominoes, as is well known, a set of tiles is provided, with the upper surface of each block or tile being divided into individual fields or segments bearing a pattern of dots, usually between one and six in number. The tiles are played alternately on a playing surface, with one segment of each piece being placed adjacent a segment of another piece having a matching number of dots.

The game of dominoes is well established and is enjoyed by a great many people throughout the world. Nevertheless, the two-dimensional nature of the game imposes a certain limit on the amount of strategy and skill involved, so that the challenge of the game is lessened somewhat for greatly experienced players. The two-dimensional aspect also means that the pieces quickly spread out over the playing surface, so that a very large surface is required if a large number of pieces are being used; this is a notable drawback when there is no large table or similar surface available for use, or where there are several players seated or moving about the playing area, as at a party, for example.

A number of variants on dominoes have been proposed in an effort to add a new element of interest and challenge. Some of these, such as those shown in U.S. Pat. No. 5,803,461 (Pavlovich) and U.S. Pat. No. 3,827,695 (Hess), although interesting, have raised the level of complexity to the point where it is very difficult for the game to be enjoyed as a simple pastime, or it is too difficult to be played by children. In other instances, such as the games shown in U.S. Pat. No. 4,968,040 (McElhaney) and U.S. Pat. No. 1,998,526 (Schubert) the variants have provided very little additional challenge, or have simplified the game to the point where it is no longer enjoyable for adults.

Accordingly, there exists a need for a game involving the placing of tiles or similar playing pieces in a correlative relationship that expands on the strategies and other challenges presented by dominoes and similar games. Furthermore, there exists a need for such a game that effectively employs three-dimensional relationships between the pieces in order to achieve such challenges. Still further, there exists a need for such a game in which a comparatively large number of pieces can be played within a relatively small area. Still further, there exists a need for such a game that is sufficiently challenging to be enjoyable for adult use, but which is not so complex that the game cannot be played in a relatively easy manner by children or as a relaxed pastime.

SUMMARY OF THE INVENTION

The present invention has solved the problems cited above, it is a game board apparatus and a method for using the same, in which there are multi-level tile-shaped playing pieces having segments that are stacked in vertical register within a confined playing area.

Broadly, the apparatus comprises a plurality of multi-level playing pieces, each playing piece having a plurality of segments bearing patterns of dots or other indicia on their upper surfaces. Some of the segments are full height whereas others of the segments are only half height, so as to form overhanging and underlying portions of the pieces. The playing pieces are stacked so that the segments of each upper piece match those segments of the lower piece or pieces where the upper and lower pieces make contact.

The game pieces may each be at least three segments long. The dot patterns or other indicia may be symmetrical in four directions in the horizontal plane. The symmetrical patterns may be dot patterns forming symmetrical "ones" and "fours".

The game apparatus may further comprise a game board having a grid pattern laid out on its upper surface, and means for defining a confined playing area within the grid pattern. The means for defining the confined playing area may comprise a plurality of fence pieces that can be selectively placed in alignment with the grid pattern at different locations so as to define areas of greater or lesser size, depending on the desired degree of difficulty.

The fence pieces may comprise a plurality of elongate members that can be placed on the game board in alignment with the grid lines. The grid lines may be formed as recessed grooves in the surface of the game board, and the fence pieces may have one or more downwardly extending ridge portions for engaging the grooves so as to hold the fence pieces in position on the game board.

The game apparatus may further comprise means for dividing the confined grid area into two or more adjacent playing areas for use by competing players. The means for dividing the confined grid area into adjacent play areas may comprise one or more divider pieces that are placed in alignment with secondary grid lines on the game board. The secondary grid lines may be more narrowly spaced than the primary gird lines, and the divider pieces may have at least one downwardly extending ridge portion for engaging the secondary grid lines. The divider pieces and grid lines may be configured to enable the confined grid area to be divided into quadrants for use by four players or teams of players. Players may score additional points by playing pieces so that they bridge the neutral areas defined between adjacent playing areas by the divider pieces.

The game apparatus may also further comprise one or more riser pieces for being placed on the game board between the fence pieces so as to form a plurality of ascending levels within the playing area. Play progresses upwardly along the ascending levels by covering each level before making contact with and progressing to the next higher level.

These and other features and advantages of the present invention will be apparent from a reading of the following detailed description with reference to the accompanying drawings.

DETAILED DESCRIPTION a. Overview

The present invention provides a game apparatus in which the playing pieces somewhat resemble those in dominoes, in that these comprise a plurality of blocks or tiles having dots or other indicia on their upper surface that match corresponding dots or indicia on adjacent pieces that have been previously played. However, rather than being two-dimensional the playing pieces of the present invention have upper and lower levels, with segments of a piece being laid on top of matching segments of a previously played piece, so that when the pieces are stacked they extend in both horizontal and vertical directions. The playing pieces are rectangular and tile-shaped, and are preferably three segments, or "fields," long.

In the preferred embodiment shown in the figures, the dots or other indicia formed on upper surfaces of the fields are perfectly symmetrical in four directions in the horizontal plane, so that the indicia will match vertically regardless of whether the pieces are overlapped in lengthwise or transverse directions. It will be understood, however, that in other embodiments the dot patterns or other indicia may not be symmetrical. Consequently, the indicia may be provided in the form of any suitable symbol, shape, pattern, color or other feature that serves to distinguish the segments. Furthermore, although three or more different indicia may be employed in some embodiments, a "binary" system employing two indicia (e.g., two different dot patterns, two different symbols, two different colors, two different words) provides an optimum level of complexity and challenge when used with playing pieces having the 3-segment configuration described herein.

A game board is provided which has rectilinear grid formed on its upper surface, for aligning the pieces so that these are played lengthwise or perpendicular to one another. Fence and divider pieces are provided for being placed on the game board along the grid lines so as to define confined playing areas within the grid, thereby forcing the players to build vertically upon the previously played pieces once the lowermost layer has been filled as completely as possible.

Figure 1:
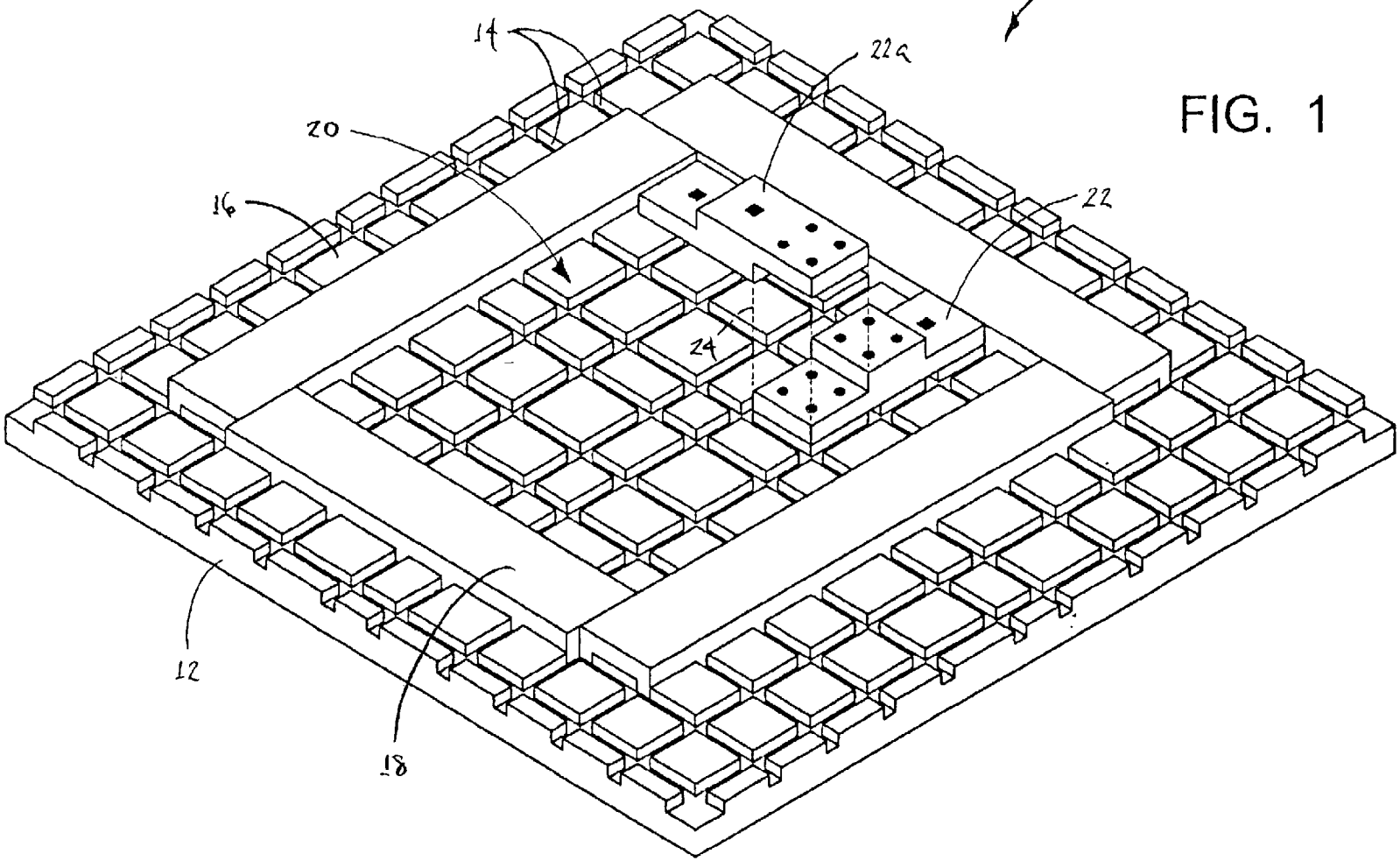
FIG. 1 is a perspective view of a game apparatus in accordance with the present invention, showing the manner in which fence pieces are placed on the game board so as to define a confined playing grid, and the manner in which the game pieces are played by placing matching portions of the pieces on top of one another.

Accordingly, FIG. 1 shows a game apparatus 10 in accordance with the present invention. As can be seen, this includes a game board 12 having rectilinear grid lines 14 formed in its upper surface 16. The fence pieces 18 are laid out in alignment with the grid lines to form a square or rectangular playing area 20 of variable size. As will be described in greater detail below, the grid lines 14 are preferably formed as grooves or channels for engaging corresponding ridges or flanges along the lower edges of the fence/divider pieces so as to form an interfitting engagement with the pieces.

As was noted above, the purpose of the confined playing area 20 is to force the player or players to build upwardly with the pieces, so as to create a challenge and ensure that the third dimension is fully utilized in play of the game. Consequently, it will be understood that the smaller the confined playing grid 20 the more challenging the play. The fence pieces are configured so that they can be placed at different positions on the game board, so that the players can define a larger or smaller playing area depending on the degree of challenge desired; for example, an experienced player or players may choose to start with a small playing area to present a greater challenge, whereas the fence pieces may be arranged to form a larger playing area for use by children or casual players.

As will be described in greater detail below with respect to the Rules of Play, the individual playing pieces 22 are set within the playing area in alignment with the grid lines 14, so that the pieces extend either lengthwise or perpendicular with respect to one another. Play is confined to the boundaries defined by the fence pieces 18, and the playing pieces are initially placed upon the surface 16 of the game board itself. As was noted above, the playing pieces 22 generally have a "stepped" configuration, with some of the segments extending full height (i.e., both levels) of the piece and other segments extending in only the upper or lower level of the piece. Thus, as can be seen in FIG. 1, where a first piece has been played and a second piece has a segment with a matching dot configuration (or other indicia), then that segment may be placed atop the matching segment of the first piece so that the two pieces overlap, as indicated by dotted lines 24. Pieces are subsequently played within the confined grid area by stacking these on top of those previously played, so long as all vertical contacting segments/fields have matching dot configurations.

The vertical stacking of the pieces, using matching segments, although easy to grasp conceptually (and therefore easily understood by children or novices) brings a high degree of sophistication and challenge to the game. Furthermore, the game requires relatively little horizontal space, and so the game can be played on a small table or even a rotating turntable if desired.

b. Playing Pieces

Figure 2:
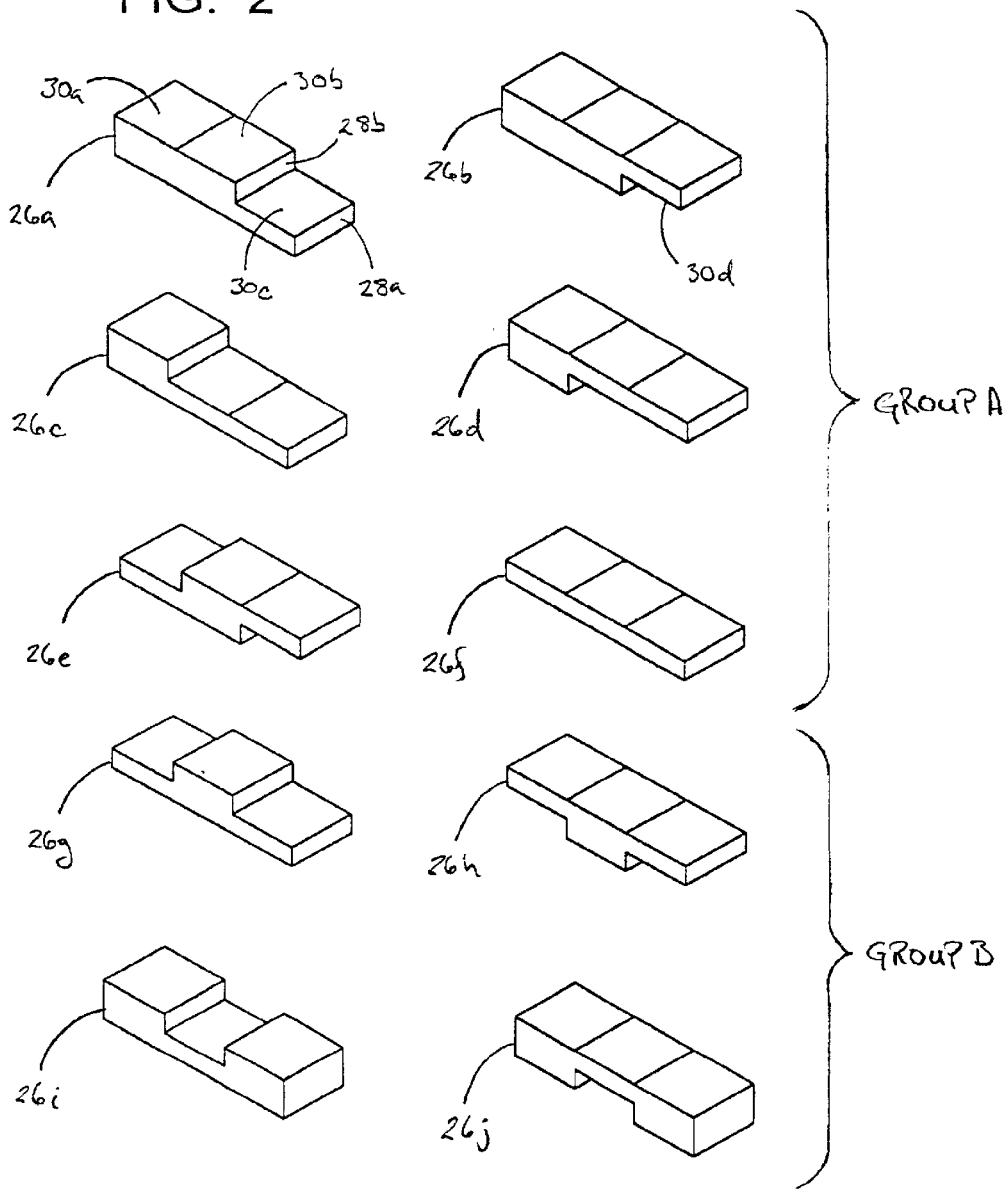
FIG. 2 is a perspective view of playing pieces for use in the game apparatus of FIG. 1, showing the different shapes of the pieces.

FIG. 2 shows a set of shapes for the playing pieces in accordance with the preferred embodiment of the present invention. As was noted above, the shapes 26*a*–26*j* generally have stepped configurations, e.g., as can be seen with respect to shape 26*a*, this has a lower level 28*a* and an upper layer 28*b*. In each of the shapes, one or two of the segments may occupy both layers, i.e., they may each extend the full height of the piece, as with segments 30*a* and 30*b* in shape 26*a*. The remaining segments occupy a single layer (i.e., they have a thickness equal to only one-half the height of the piece), so as to form an underlying segment as indicated at 30*c* or an overhanging segment as indicated at 30*d*. The single-layer segments permit the pieces to be overlapped on top of one another in the manner described above. Furthermore, the overhang formed by the projecting upper layers 30*d* serves to form a "cantilever" that can be employed in certain aspects of game play.

In the preferred embodiment that is shown in the figures, the pieces are each three segments long; consequently the various combinations of full-height and half-height segments yields a total of ten shapes 26*a*–26*j*, excluding a shape that would be full-height over its entire length, i.e., there is no block having three fill-height, two layer segments. In the case of shape 26*f*, there are three half-height (single layer) segments, in which instance the upper layer is considered to be a "null."

The shapes 26*a*–26*j* can therefore be considered as a series of "blanks," with the dot patterns or other indicia being applied on top of each segment considered to form the actual playing pieces. As can be seen in FIG. 2, the piece shapes are categorized in two different groups, i.e., shapes 26*a*–26*f* constitute "GROUP A," while shapes 26*g*–26*j* make up "GROUP B"; as will be described in greater detail below, the shapes from each group are matched with pattern sequences from a corresponding group of dot patterns.

For the reasons noted above, the dot patterns on each segment are symmetrical in both longitudinal and lateral directions (i.e., the patterns are symmetrical in four directions in the horizontal plane), so as to permit pieces to be played lengthwise and crosswise atop one another. The dot patterns may be formed as raised pegs or "bumps", with corresponding sockets or recesses being provided on the underside of the segment. The interfitting engagement between the pegs and sockets prevents the pieces from being played incorrectly, i.e., the pegs for one pattern will not fit into the sockets for the second, non-matching pattern, in essence providing an "anti-cheating" feature; furthermore, the engagement between the pieces helps to create a more stable structural relationship as the pieces are stacked in a vertical direction, thereby making the game physically easier and more enjoyable to play and also preventing the pieces from accidentally toppling over.

In the embodiment that is illustrated, the dot patterns are limited to "ones" and "fours." These patterns provide the desired four-directional symmetry and are also easily recognizable shapes, and furthermore the pattern of four pegs will not fit into a socket for one peg, and vice-versa. It will be understood, however, that in some embodiments other forms of dot patterns or symmetrical or non-symmetrical shapes or other indicia may be employed. Furthermore, a greater number (e.g., three or more) of dot patterns or other indicia may be employed, although this increases the number of possible combinations, which in turns means that many more pieces are needed and that the game becomes much more complex to play. Similarly, in some embodiments the playing pieces have more than three segments, although again the added segments greatly increase the complexity of the game.

A further advantage of the 3-segment configuration, and particularly the 3-long, 1-wide 2-high configuration in combination with the dual (e.g., 1-dot, 4-dot) indicia, is that this makes it possible to frequently play the pieces in a "cantilevered" fashion, i.e., with one or more of the segments in an overhanging orientation where they are unsupported by underlying pieces. As will be described below, the option of "cantilevered" placement greatly enhances the challenge and enjoyment offered by the game. 4-segment (or longer) pieces, however, would in most situations tip over instead of permitting cantilevered placement. Consequently, for the majority of players, the combination of three-segment playing pieces and two dot patterns or shapes/indicia has been found to provide an optimal combination of playability and sophistication.

Figure 3:
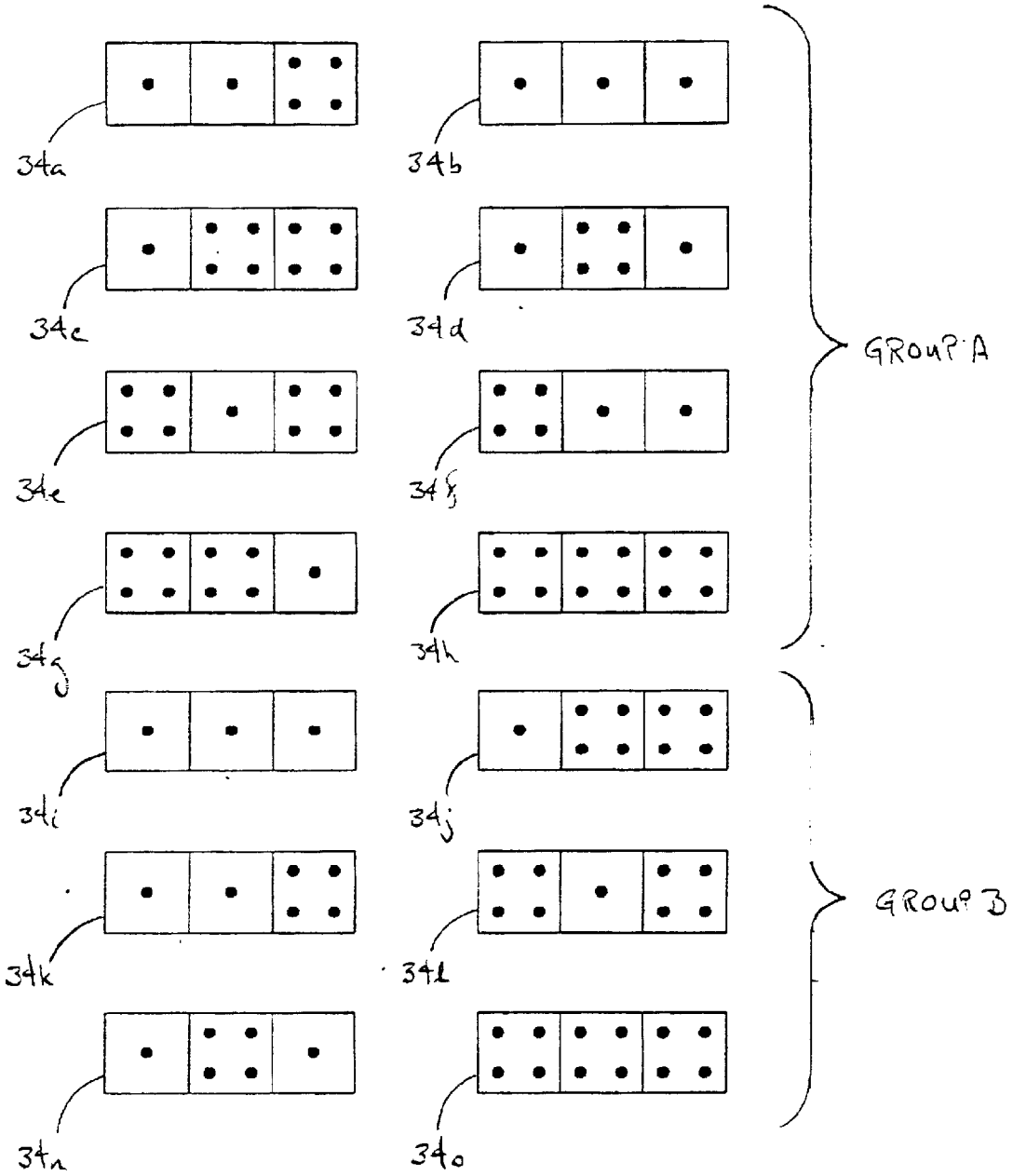
FIG. 3 is a top, plan view of the playing pieces used in the game apparatus of the present invention, showing the sequences of dot patterns that are arranged on the surface of the pieces.

Combining first and second dot patterns and three segments on each playing piece, there are a total of eight possible dot configurations. Applied to the ten different shapes shown in FIG. 2, this yields a total of eighty playing pieces; however, a number of these pieces are duplicates, which tends to reduce the challenge of playing the game. Employing the relationships shown in FIGS. 2 and 3 provides a more optimal set of playing pieces. Specifically, the sequence of dot configurations shown in Group A (34*a*–34*h*) is applied to blanks having each of the shapes in Group A in FIG. 2; since there are eight dot configurations and six shapes in Group A, this forms the first group of 48 pieces. Similarly, the six dot configurations in Group B in FIG. 3 and four shapes in Group B in FIG. 2 produces a second group of 24 pieces, giving 72 pieces in all. This removes eight duplicate pieces out of the possible 80 mentioned above, but leaves two duplicate combinations in the "flat" pieces (shape 26*f*), which helps to get play moving when starting with the initial, empty playing grid.

c. Game Board

Figure 4A:
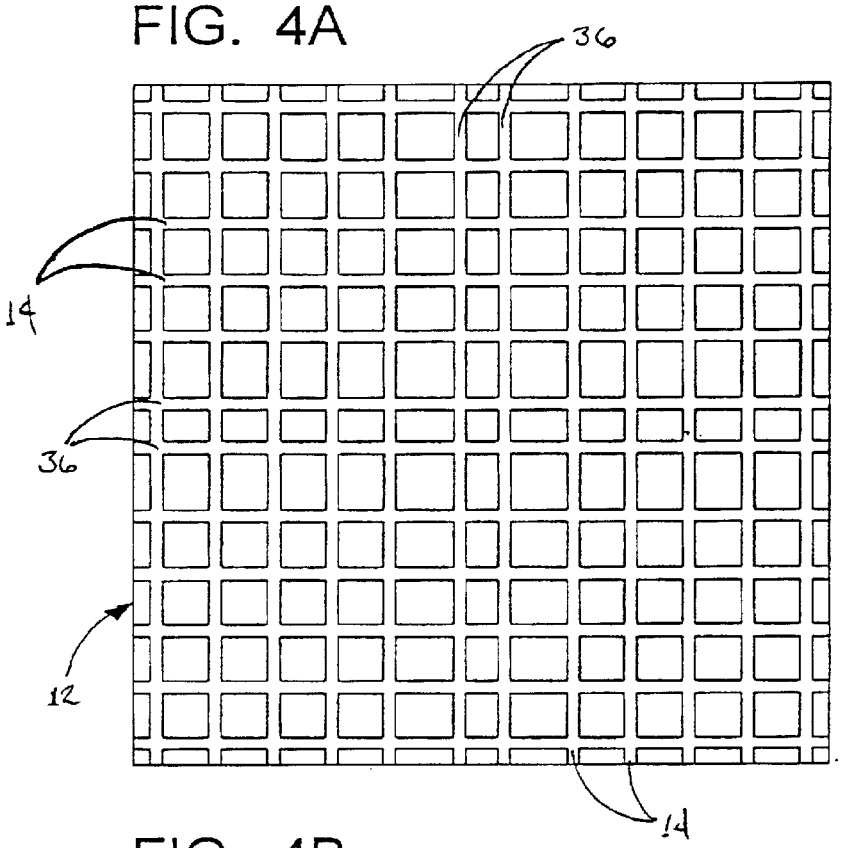
FIG. 4A is a top, plan view of the game board of the playing apparatus in FIG. 1, showing the grooves or channels which are formed in the upper surface thereof so as to form a grid for arranging the fence and game pieces thereon.
Figure 4B:
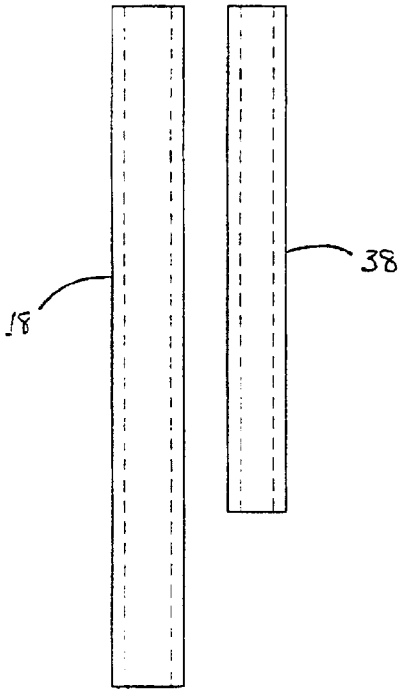
FIG. 4B is a top, plan view of the fence and divider pieces that are placed on the game board to define the confined playing areas thereon.

FIG. 4 shows game board 12 in greater detail. As can be seen, the rectilinear grid 14 that is formed in the upper surface of the board includes parallel, relatively widely spaced primary grid lines 14 and pairs of more narrowly spaced secondary gridlines 36 which divide the playing board into quadrants. As was noted above, the primary gridlines serve to align the fence and playing pieces in the desired rectilinear relationships. The secondary gridlines 36, in turn, serve to align somewhat narrower divider pieces 38 (see FIG. 4B) on the game board, the use of which will be described in greater detail below.

Figure 4C:
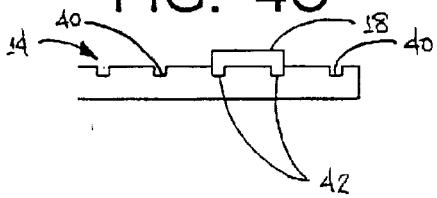
FIG. 4C is an end, cross-sectional view of a portion of the game board of FIG. 4A and one of the fence pieces of FIG. 4B, showing the manner in which parallel, depending flanges on the bottom of the fence piece engage corresponding grooves of the surface of the game board so as to establish engagement between the members.

As can be seen in FIG. 4C, the gridlines are preferably formed as a series of parallel channels or grooves 40 in the upper surface of the board. Each of the fence pieces 18 includes first and second ridges or flanges 42 that extend downwardly along its edges for being received in the grooves, so as to form a stable interfit between the pieces and the game board. This ensures proper positioning of the fence pieces, and also prevents them from sliding or otherwise moving about while the game is being played. The narrower divider pieces 38 are similarly provided with parallel, downwardly extending ridges for engaging the grooves that form the more closely spaced quadrant lines 36. The stability which is provided by the grooved grid lines is beneficial in terms of making the game easier to set up and play; it will be understood, however, that in some embodiments the grid lines may simply be printed or otherwise drawn on the surface of the game board rather than being formed as indented channels or grooves, so long as the grid lines enable the fence pieces to be aligned in the proper directions, and also allow them to be adjusted to form bigger/smaller playing areas as desired.

Figure 5:
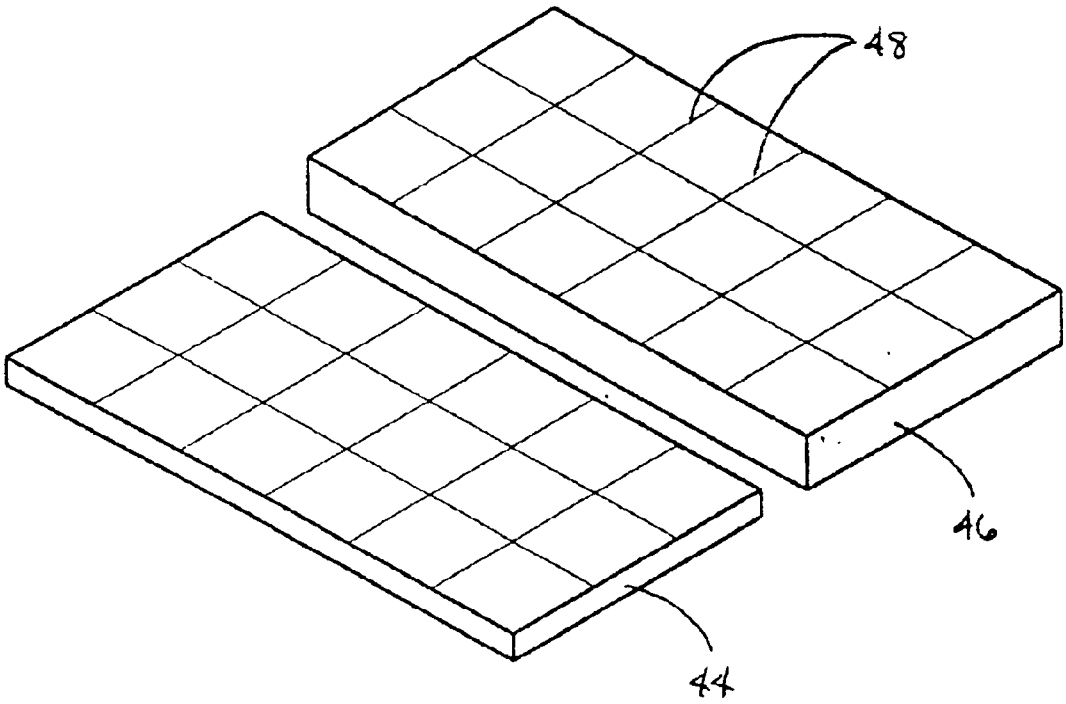
FIG. 5 is a perspective view of first and second step-like riser pieces that are placed on the game board of FIG. 4A to form a series of ascending levels upon which the game pieces are played.

FIG. 5 shows first and second riser pieces 44,46, which, like the quadrant divider pieces described above are used in optional play of the game, as will be described in greater detail below. The riser pieces may, depending on the embodiment, have a height equal to the full height or one-half the height of the playing pieces, i.e., they may have a thickness equal to one or two layers of the playing pieces; it will be understood that in some embodiments the riser pieces may be even higher/thicker, although this tends to render play increasingly difficult. Also, although FIG. 5 shows two riser pieces, there may be more or fewer of the riser pieces as desired.

As is shown in the figures, the riser pieces preferably all have the same length, so that these can be placed between parallel fence pieces, in the manner that will be described below. The riser pieces are provided with gridlines 48 on their upper surfaces for alignment of the playing pieces, similar to the grid on the surface of the playing board itself, although in general these will simply be printed or otherwise marked on the upper surfaces of the pieces rather than being formed as grooves/channels.

The game board, playing pieces, fences, dividers and risers may be formed of any suitable material, such as wood, plastic, cast resin, porcelain, ceramics, plaster, metal and so on.

d. Rules of Play

The rules of play are discussed below with reference to the preferred embodiment which is illustrated in the figures and which has been described above. It will be understood, however, that the rules may be modified for use with playing pieces and game boards/parts having sizes, shapes or numbers different from those described above; for example, the rules may be modified for use with game pieces having more than three segments, or for use with game pieces having surface indicia other than the dot patterns of "ones" and "fours" described above. Furthermore, some embodiments may be played without the feature of keeping score, especially if the indicia do not include dots or numbers (such as two colors, for example), which embodiments may be especially suited for use by children in a play or instructional environment.

i. Basic Play

The basic object is to stack pieces in the playing area until one player plays his last piece. The first player to use all of his pieces or "go out" wins the hand, and receives all of the points left in the other player's hands, similarly to the scoring in conventional dominoes. In the preferred embodiment, in which all of the pieces have three segments and each segment has either a "one" or a "four", the pieces are scored according to the total of the points on their segments.

The total number of points needed to win the game is determined in advance, and the pieces are dealt and played in a series of hands until one of the players reaches the number of points awarded to win. The score needed to win may suitably be determined by multiplying the number of players by a predetermined number that relates to the number of hands normally necessary for one player to accumulate that number of points. For example, for a comparatively short game the players can play until the first person reaches a total equal to the number of players multiplied by 15 points (e.g., 4 players×15 points=60 points total needed to win), or for a longer game, play can continue until the first person reaches a goal equal to the number of players times 30 points or some higher figure.

Figures 12, 13:
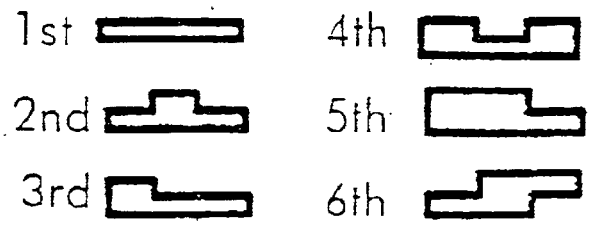
FIG. 12 is a table setting out recommended sizes of grids for easy, normal and hard levels of play, based on the number of players and a starting set of seven pieces for each player.
FIG. 13 is a chart setting out the ranking of pieces, based on shape, for determining the starting piece by which play of the game is commenced.

In initial set-up, the fence pieces 18 are placed on the grid to form the perimeter of the confined play area as shown in FIG. 1. The size of the grid within the play area is selected based on the number of players and the desired level of difficulty; as was noted above, the smaller the play area, the more difficult the challenge. Recommended grid sizes, based on each of the players starting with seven pieces, is set forth in the table of FIG. 12.

For ease of play, the play area should be centered within the game board as much as possible.

After setting up the board, the playing pieces 22 are shuffled (e.g., inside a bag) and dealt out to the players; an initial hand of seven pieces is recommended, although in 2–4 player games the players may elect to use nine or eleven pieces instead of seven, which makes for more challenging and longer hands; when using more than seven pieces per player, the playing area should be increased somewhat to provide the desired degree of difficulty. Players will ordinarily wish to screen their pieces from view by the other players, and a shield or similar piece may be included for this purpose.

A dealer is first selected by a suitable means, such as by drawing pieces. Thus, following the deal, the player seated to the left of the dealer begins play, with the deal rotating thereafter in a clockwise direction. The first player plays the highest-ranking "starter piece" in his hand: the starter pieces are those which have at least two contiguous lower level segments, i.e., shapes 26*a*, 26*b*, 26*c*, 26*e*, 26*f*, 26*g* and 26*i* in FIG. 2. Alternatively, play may start with the player who holds the highest-ranking starter piece in his hand. The ranking of the starter pieces is based first on their shape and secondly on the number of points on the piece, the ranking of the shapes being as set forth in the table of FIG. 13.

As can be seen therein, the highest-ranking starting piece is the "triple four" flat piece. If two players each have a flat piece of the same value, then those two players move to the second-highest piece in their hands to determine who starts. If nobody has a flat piece in his hand, than the highest piece would be the second ranking shape (i.e., shape 26*g*) bearing a "triple four," and so on.

Once the first piece has been played, play continues clockwise to the next player, with each player playing one piece at a time.

The initially open surface within the playing grid 20 is considered a "free play" area, in that any segment of a piece may be played on it. After that, any contact between stacked segments of the pieces must match top to bottom. In all cases, at least two out of the three segments of a piece must contact the underlying surface or segment, never just one.

The play area defined by the fence pieces represents the boundaries within which the pieces can be played, with the boundaries extending upwardly from the fence pieces. No pieces may be played so as to cross the boundaries. Gaps are naturally formed within the stack and are permitted, so long as two segments of each piece make contact with the lower layer or layers. No play may be made if it will cause the pieces to topple over or fall; however, certain such plays may later be possible when pieces are added that act as a counterbalance.

If a player finds that he cannot make a play using the pieces in his hand, then that player must draw one piece from the "pile" of undealt pieces, and play then resumes in a clockwise direction. If all 72 pieces are drawn, play is continued until a player goes out or no player can make a play. If no one can make a play, than the player with the lowest remaining number of points in his hand wins; in the case of a tie, players with equally low hands split the points in all players' hands.

At each turn, the player must play that piece in his hand that can be played as low as possible within the playing area. This means that at least one of the segments of the piece must be on the lowest level existing within the playing area, either the initial surface of the game board or the lowest segment of the pieces that are stacked within the playing area. After it has been determined that it is not possible to play a piece at a lower level, then it is permissible to play a piece at the next higher level.

If an opponent sees that a player has not played as low as possible, then the opposer may challenge the play. If a challenged piece has in fact been played too high, then it is removed and the challenger gives one of his pieces to the player who did not follow the "low as possible" rule, thereby increasing the number of pieces that the offender must play in order to go out. If, however, the challenged play is determined to have been correct, then the challenger receives one piece from the challenged player. Play then resumes as before. Optionally, as a less strict rule, the challenged player may simply have the piece removed and lose his turn if a piece has been found to have been played too high, and if it is found that the play is proven valid then the piece stays in place.

Upon completion of each hand, the playing pieces are removed, shuffled, and dealt again for subsequent hands, which are played in the same manner as described above. Points are totaled at the end of each hand, and the first player to reach the chosen goal wins the game.

ii. Quadrant Play

The term "quadrant play" refers to play in which the game board is divided into separate, adjoining grid areas for use by opposing players. In a preferred embodiment, the game board is divided into four grid areas, hence the term "quadrant", but in other instances the game board may be divided into two playing areas (as will be described in below), or into some other number of areas besides four. The multiple players may compete on an individual basis, or may be divided into teams. The object of this aspect of the game is for 2–4 individual players or 2–4 teams of players to play within their own grid areas and try to go out.

Figure 6:
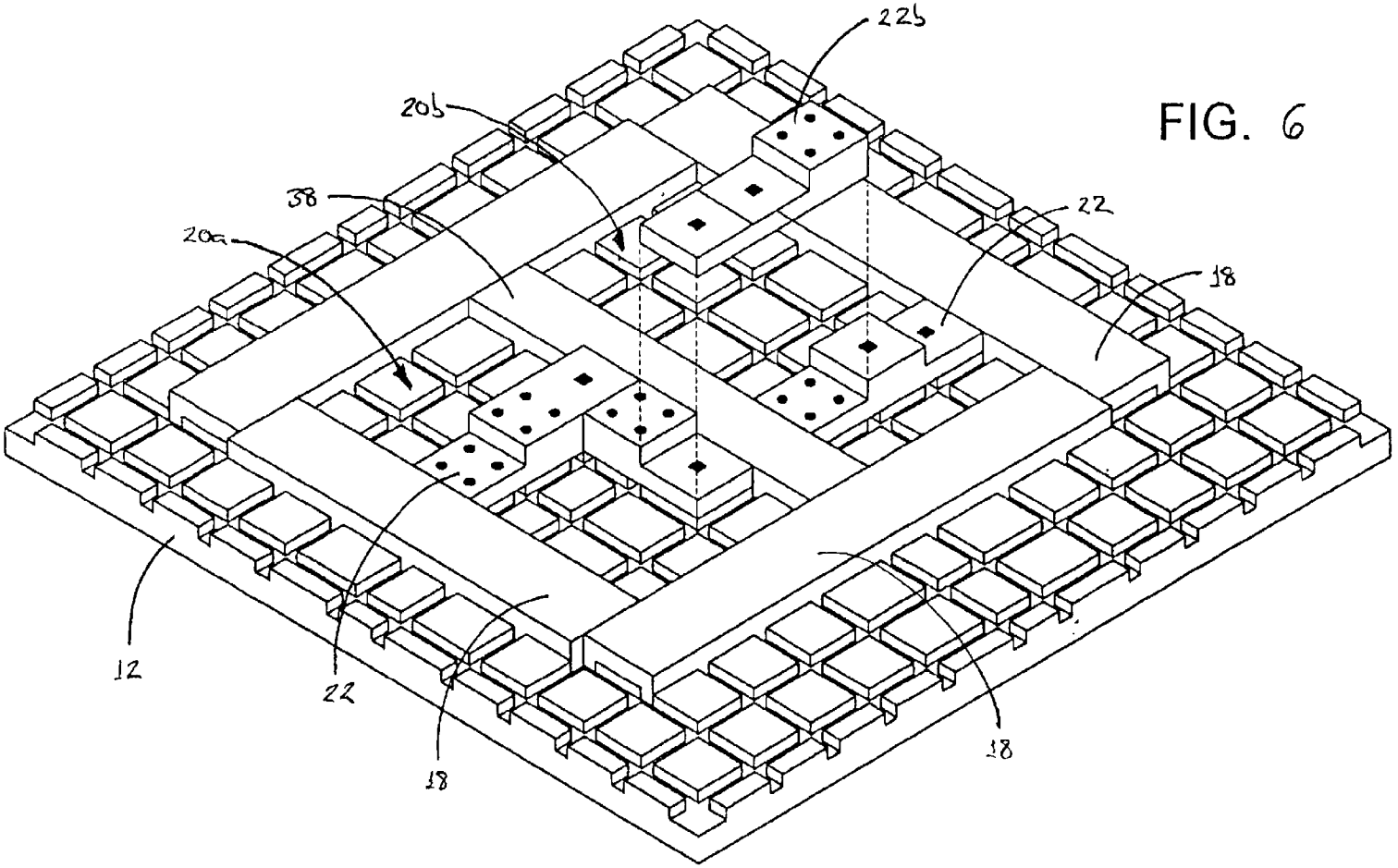
FIG. 6 is a perspective view, similar to FIG. 1, showing the manner in which the fence and divider pieces may be placed on the game board so as to define separate playing areas for two or more players, and also showing the manner in which the same pieces may be played so as to bridge the divider piece that forms the boundary between adjacent playing areas.

FIG. 6 therefore shows the game apparatus 10 arranged for "quadrant play"; in this view, the game apparatus is set up to form two adjacent playing grids, although as was noted above, there may in some instances be four (or some other number) of grids. To set the board up in this manner, the four outer fences 18 are placed on the grid of the playing board to form a grid of suitable size, e.g., 9×9. One of the narrow divider pieces 38 is then placed along the secondary quadrant lines 36 (see FIG. 4A) to form two 4×9 grid sections 28, 20*b*. If it is desired to have four playing fields, a second set of divider pieces 38 are placed in the crosswise secondary grid lines 36 to split each 4×9 section into two 4×4 grids, giving a total of four 4×4 grids.

The rules are similar to those for basic play as described above, except that in Quadrant Play, the players or teams may score extra points by playing game pieces across the "neutral areas" defined by the divider pieces. To illustrate this, FIG. 6 shows a piece 22*b* being played so as to bridge the "neutral zone" defined by divider piece 38, with a "one" segment at each end of piece overlapping a "one" segment of separate pieces on opposite sides of the divider. Playing across the "neutral area" is the only time the borders can be crossed, and the play receives a score of either one or four points (in the embodiment which is illustrated), depending on the segment that lands in the opposing grid.

The playing pieces are shuffled and dealt to the players in the manner described above. For quadrant play using four 4×4 grids, a deal of 11 or 13 pieces (the latter being harder) is suitable. If teams are playing, each player may suitably be dealt 6–7 pieces, depending on the desired level of difficulty.

Scores for plays across the neutral areas are tallied as they happen. If a score puts a player over the total amount of points needed to win the game, then that player wins and play does not continue.

In team play the same rules apply, except that both team members must use all of their pieces to go out. Team players alternate their seating according to their respective grids and play rotation.

For an added element of competitiveness, rules for quadrant play may be modified to permit the players or teams to play simultaneously without taking turns. The players or teams thus play as fast as they can or "race", still following the rules for proper placement of pieces, and the first player or team to go out wins the hand or game.

iii. Riser Play

The "riser play" variant of the game utilizes the riser pieces shown in FIG. 5. The object is for one or more players to "cover" the riser grids and use all of the pieces to go out. By "cover" it is meant that by looking directly down at the grid, all spaces on the grid are covered by segments of the playing pieces; each grid must be "covered" before the player can advance to the next higher level.

Figure 7:
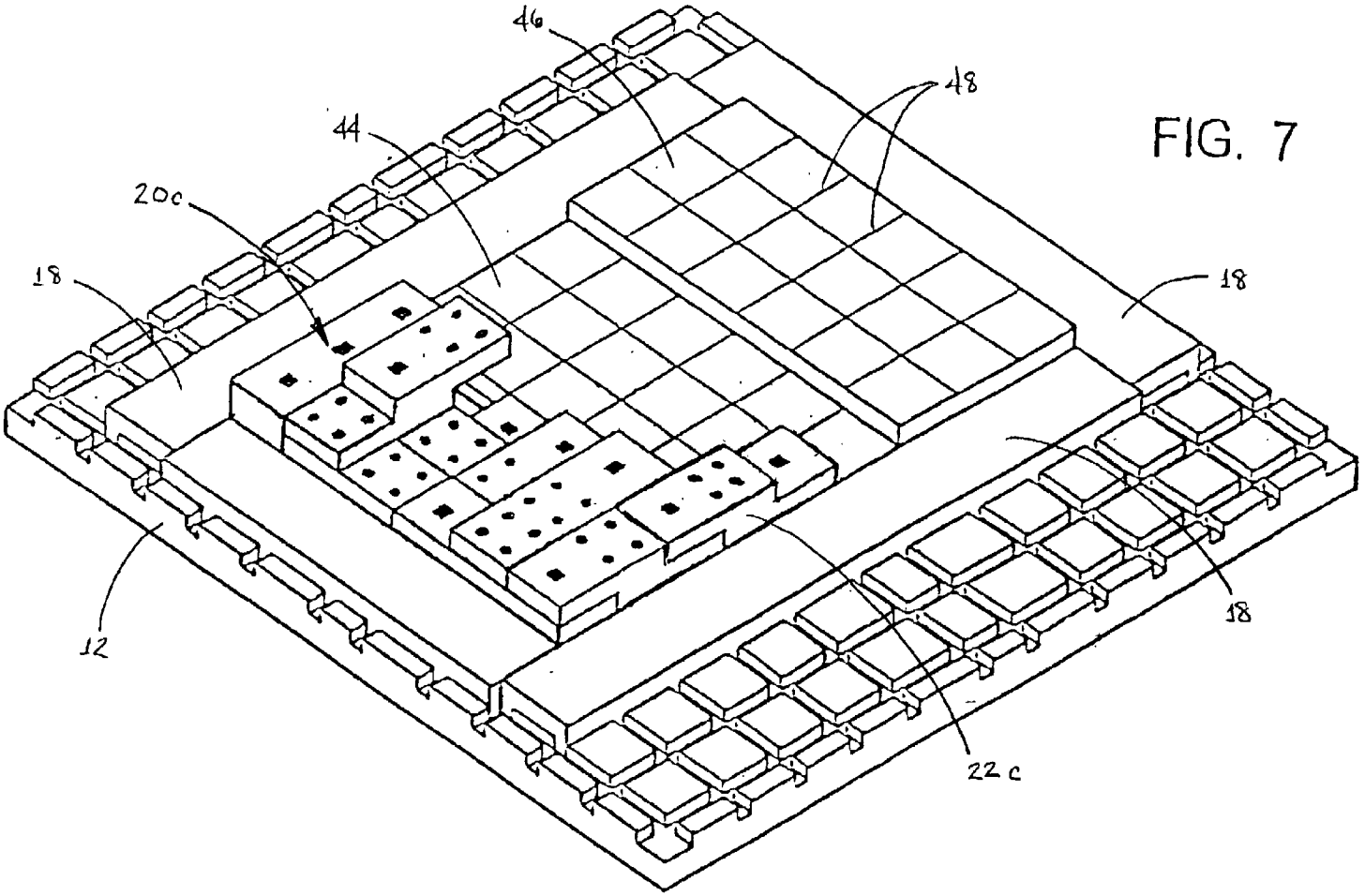
FIG. 7 is a perspective view, similar to FIGS. 1 and 6, showing the manner in which the riser pieces of FIG. 5 are placed within the playing area that is defined by the fence pieces so as to form a sequence of ascending levels on which the game pieces are played, beginning with the lowermost level and progressing upwardly.

FIG. 7 shows the game apparatus arranged for riser play. As can be seen, the outer fence pieces 18 are placed on the game board to define a playing grid 20*c* of suitable size (e.g., a 9×9grid), with the length of the riser pieces matching the width of the grid area; e.g., for use on a 9×9grid, the riser pieces are suitable nine spaces long and three spaces wide.

The highest riser piece 46 is placed at the back of the playing area 20*c*, and the next highest riser piece 44 is placed in front of the first riser piece. The surface of the playing grid in front of the lowest riser piece remains bare, so that the board and riser pieces define a series of three riser steps having the same grid size, e.g., 3×9. For a suitable level of difficulty, one player may play each of the three levels as a 3×3 grid, in which case three players can play side-by-side on the 9×9grid; alternatively, the player can increase the width of the grid steps in play (e.g., 4×3, 5×3, and so on), using three additional pieces for each increase in width.

Once the first level has been "covered," as described above, the play may proceed to the second, next higher level, by playing a piece so that it bridges or connects between the first level and the next. For example, FIG. 7 shows piece 22*c* being played so that at least one segment of the piece rests on a matching segment of a piece on the lower level, and at least one other segment of the piece 22*c* rests on the next higher level 44. Once contact has been made with the next higher level, pieces can no longer be played on the lower level (i.e., play cannot go "back down" to a lower level).

After reaching the second level, the player must "cover" this with the pieces in the same manner as the first level. Once the second level has been covered, play may proceed to the third level by making contact in the manner described above. Once on the third, (i.e., highest) level, the player must cover the third level and go out in order to win the game.

With the exceptions described above, the "basic play" rules apply to the "riser play" game as well.

e. Tower Play

Figure 8:
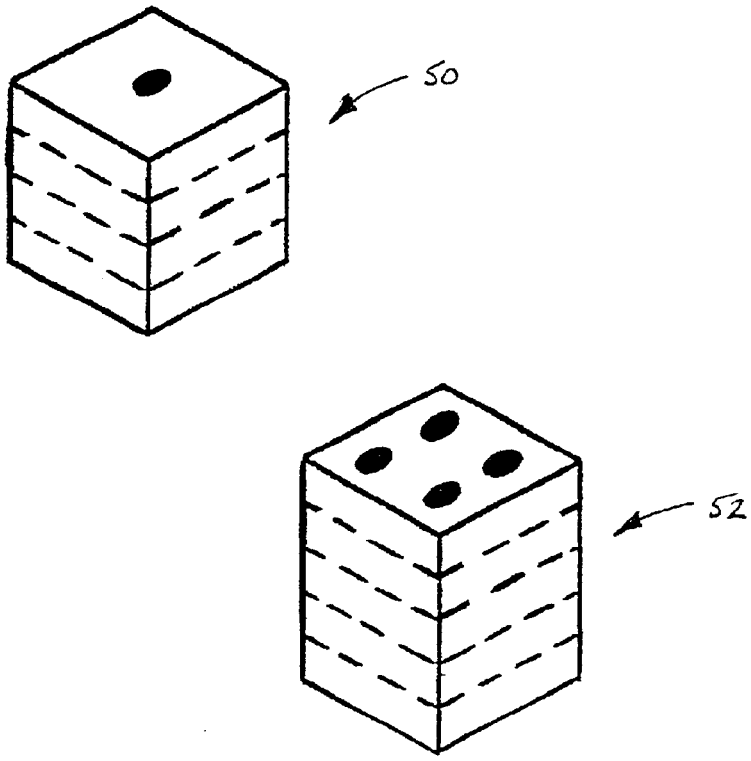
FIG. 8 is a perspective view of first and second tower pieces that are optionally placed on the playing area so as to provide a target during the course of stacking the tile-shaped playing pieces.

To provide an element of increased interest and challenge, certain "tower" pieces can be preset within the playing grid, e.g., square pieces covering a single square. As can be seen in FIG. 8, the tower pieces are preferably two or more levels high; for example, tower pieces 50, 52 are four and five levels high respectively. In this manner, the top of each towers piece provides a target once the playing pieces have been stacked to a particular height.

The top of the "tower" piece may be provided with a dot pattern or other indicia (e.g., a "one" or "four" dot pattern) matching that on the segments of the playing pieces, in which case the tower piece serves a role analogous to a "wild card" in that it provides an opportunity for the player to use the upper end of the tower piece when play reaches a high enough level. The tower piece may also be provided with a particular color, wording or other indicia denoting that a special play is to be made if a player is able to play one of his pieces on top of it; e.g., a particular tower piece may permit the player to "go again" if it is played upon, so that the player is given a second turn, or it may indicate "give" so that the player is able to give one of his pieces to an opponent, or "reverse rotation" so that the direction of play is reversed amongst the players, and so on.

The tower pieces thus provide certain goals that bring an additional element of strategy to the game. They also have an "equalizing" effect, tending to reduce any advantage stemming from being the first to play. The tower pieces may be placed anywhere on the playing grid, although it is generally advantageous to place them near the corners and no closer than three squares apart. Preferred heights for the tower pieces are in the range of 2–5 levels when used with the set of playing pieces described above, since one level provides little challenge and the playing pieces are rarely stacked to a height of more than six levels during ordinary play.

f. Additional Variants

Figure 9A:
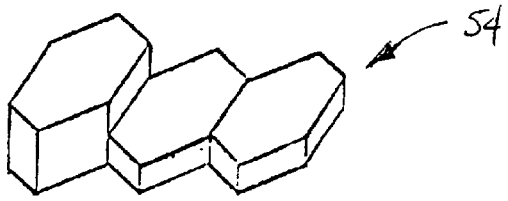
FIG. 9A is a perspective view of a playing piece of a game apparatus in accordance with an embodiment of the present invention in which the segments of the playing pieces have a hexagonal configuration rather than square as shown in FIG. 2.
Figure 9B:
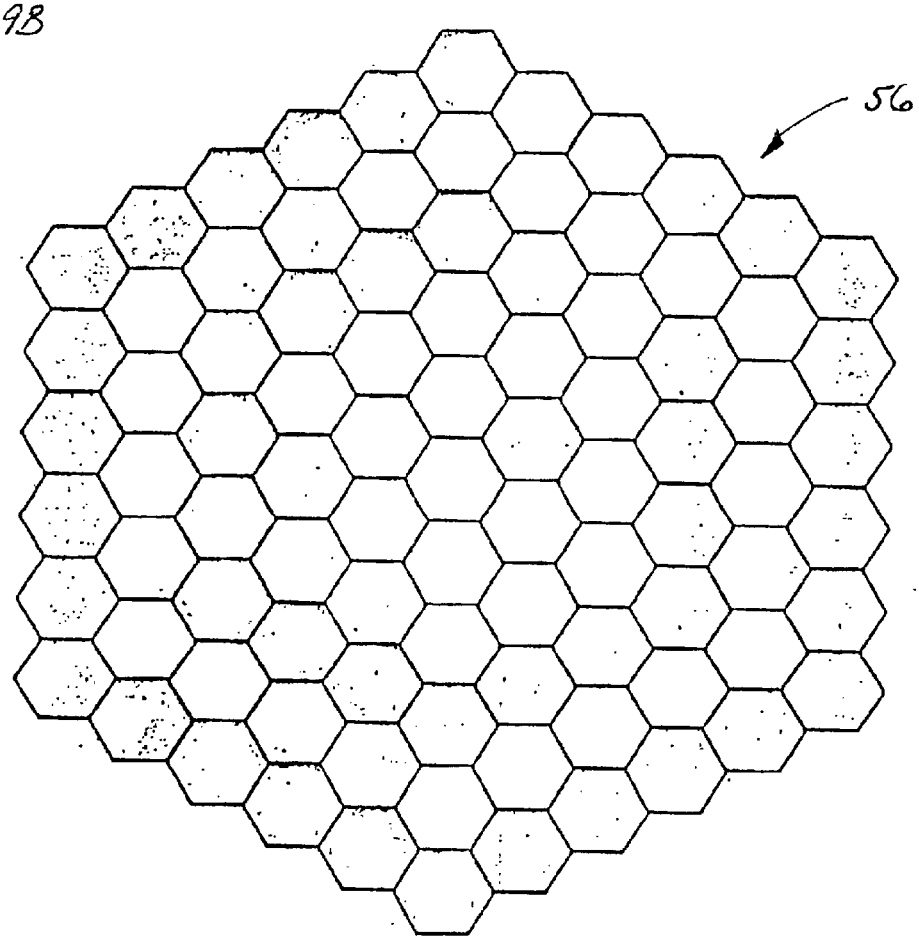
FIG. 9B is a plan view of a game board for use with the hexagonal-segment playing pieces of FIG. 9A, showing the honeycomb pattern in which the hexagonal segments fit together when played.

Rather than rectangular pieces having square segments/fields, the segments may be hexagonal so that the pieces fit together in a "honeycomb" pattern as shown at 54 and 56 in FIGS. 9A and 9B. As was noted above, still other configurations may be used in other embodiments.

Figure 10:
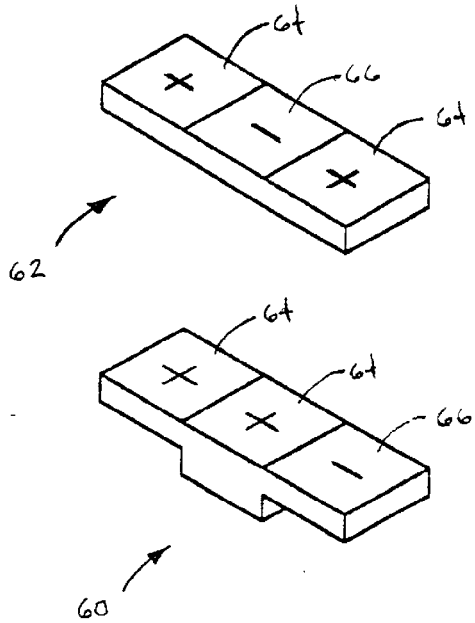
FIG. 10 is a perspective view of first and second selected playing pieces of a game apparatus in accordance with an embodiment of the present invention in which the segments of the playing pieces are magnetized so as to have a first pole directed upwardly from the segment and the opposite pole directed downwardly therefrom.

Furthermore, the game apparatus of the present invention may be provided with playing pieces having individually magnetized segments, so as to either augment or replace the mechanical engagement between overlying segments as the pieces are played. FIG. 10 shows first and second such playing pieces 60, 62, each of which includes one or more "positive" segments 64 and/or "negative" segments 66. For ease of illustration, the segments are shown as being marked with a "+" or "−", however, it will be understood that the dot patterns described above or any other suitable surface indicia may be employed to differentiate the segments.

Figure 11A:
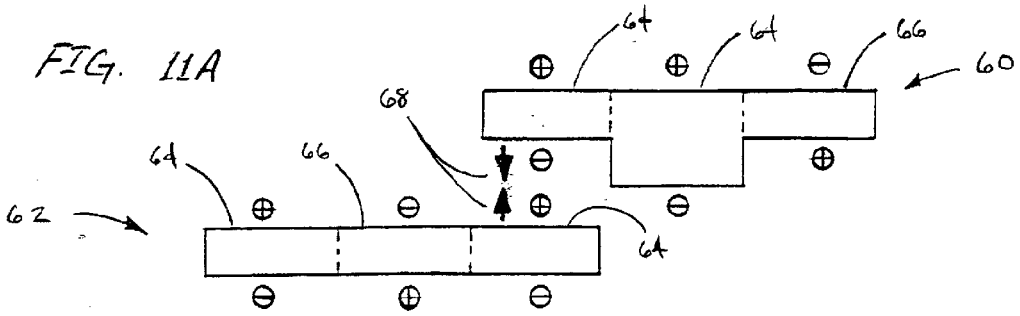
FIGS. 11A–11B are first and second side, elevational views of the magnetized playing pieces of FIG. 10, showing the manner in which correctly matched segments are drawn together vertically by the magnetic forces while incorrectly matched segments are replaced thereby.
Figure 11B:
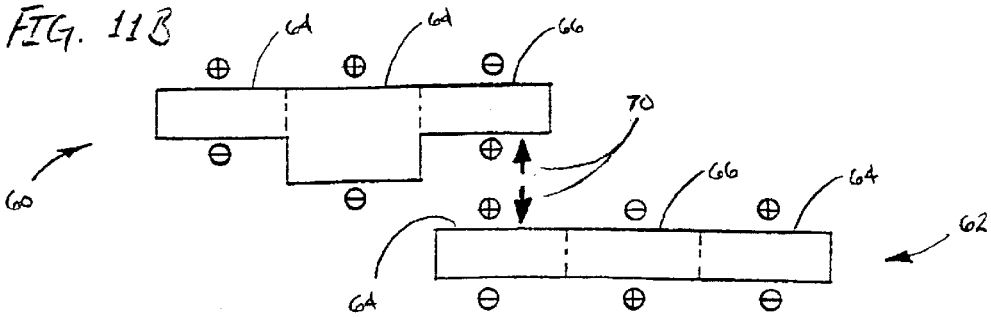

As can be seen in FIGS. 11A–11B, each of the "+" segments 64 has a positive magnetic pole that is disposed upwardly, and a negative pole that is disposed downwardly, and each of the "−" segments has a positive pole that is disposed downwardly and a negative pole that is disposed upwardly. This may be accomplished, for example, by imbedding individual permanent magnets within each segment, with the magnets being inverted to orientate either the negative or positive pole upwardly as appropriate. The strength of the magnets should be sufficient to produce the desired attraction or repulsion when the segments are brought into contact, but not so strong as to prevent a non-matching segment from being played above an intervening gap, which is permitted by the preferred rules.

Accordingly, as can be seen in FIG. 11A, when matching segments are placed atop one another (as the two "positive" segments 64 on pieces 60 and 62 in FIG. 11A), the negative pole of the first segment is disposed towards the positive pole of the other segment, so that the magnetic force draws the two segments together as indicated by arrows 68. By contrast, if the segments are improperly matched, e.g., if a "negative" segment is placed over a "positive" segment as shown in FIG. 11B, the like poles will be disposed towards one another so that the magnetic force will tend to push the pieces apart, as indicated by arrows 70.

The individually magnetized segments thus serve to ensure that the pieces are properly played (i.e., matching segment placed atop matching segment) and therefore reduce or obviate the need for a mechanical interconnection. Moreover, once joined, the magnetic forces tend to resist separation of the pieces, so that this embodiment of the invention is particularly suited for use when traveling. Also, the magnetic engagement between the pieces allows them to be played to increased heights with less risk of toppling over.

It is to be recognized that various alterations, modifications, and/or additions may be introduced into the constructions and arrangements of parts described above without departing from the spirit or ambit of the present invention.

What is claimed is:

1. A game apparatus, comprising:

a plurality of elongate, tile-shaped playing pieces, each said playing piece having at least three substantially equal-sized segments arranged in a row so that when viewed from a top side said piece is one segment wide and at least three segments long, each of said segments having a substantially identical shape so that segments of said pieces are individually superimposable upon one another;

said segments of at least some of said playing pieces being distinguished by at least first and second indicia on said top sides thereof;

at least some of said playing pieces having differing stepped configurations as viewed from a side such that some of said segments thereof have a two-level thickness and other segments thereof have a one-level thickness so as to form overhanging or underlying portions of said playing pieces;

so that said playing pieces are stackable in play with indicia that match on each segment of upper and lower pieces that are in contact with one another.

2. The game apparatus of claim 1, wherein said indicia on said segments of said playing pieces are symmetrical in at least four directions in a horizontal plane so as to permit said pieces to be stacked both lengthwise and crosswise atop one another.

3. The game apparatus of claim 2, wherein said indicia on said segments of said playing pieces comprise visible indicia on upper surfaces of said segments.

4. The game apparatus of claim 3, wherein said visible indicia comprise first and second dot patterns, said first dot pattern comprising a single dot located centrally on said upper surfaces of segments and said second dot pattern comprising four dots arranged in a square on said upper surfaces of said segments.

5. The game apparatus of claim 4, wherein said dot patterns are formed on raised pegs on upper surfaces of said segments, and wherein said segments each comprise at least one recess formed in a lower surface thereof in a pattern corresponding to said dot pattern on said upper surface of said segment, so that said pegs interfit with said recesses only when matching segments are played atop one another.

6. The game apparatus of claim 2, further comprises:

means for establishing engagement between said segments of said upper and lower pieces that are in contact with one another so as to permit only segments having matching indicia to be placed atop one another.

7. The game apparatus of claim 6, wherein said means for establishing engagement between said segments of said upper and lower playing pieces comprises:

means for establishing mechanical engagement between said segments of said upper and lower pieces.

8. The game apparatus of claim 6, wherein said means for establishing mechanical engagement between said segments of said upper and lower pieces comprises:

at least one matching peg and socket associated with each of said indicia, each said peg and socket associated with a segment being configured to permit engagement only with a segment having matching indicia.

9. The game apparatus of claim 6, wherein said means for establishing engagement between said segments of said upper and lower playing pieces comprises:

means for establishing magnetic engagement between said segments of said upper and lower pieces.

10. The game apparatus of claim 9, wherein said means for establishing magnetic engagement between said segments of said upper and lower playing pieces comprises:

a magnet on each of said segments, said magnets on said segments having said first indicia being mounted so that positive pole thereof is disposed upwardly and a negative pole thereof is disposed downwardly, and said magnets on said segments having said second indicia being mounted so that a negative pole thereof is disposed upwardly and a positive pole thereof is disposed downwardly, so that stacked segments having matching indicia will be drawn together by opposing magnetic poles and stacked segments having non-matching indicia will be forced apart by matching magnetic poles.

11. The game apparatus of claim 1, further comprising:

a game board having a grid pattern formed thereon for aligning placement of said playing pieces.

12. The game apparatus of claim 11, further comprising:

means for defining a confined playing area on said grid pattern for placement of said playing pieces therein.

13. The game apparatus of claim 12, wherein said means for defining a confined playing area on said grid pattern comprises:

a plurality of elongate fence pieces for being placed in alignment with said grid pattern so as to selectively define confined playing areas of varying size.

14. The game apparatus of claim 13, wherein said grid pattern comprises a pattern of straight grid lines, and wherein said fence pieces comprise a plurality of elongate, straight fence pieces for being placed on said game board in alignment with said straight grid lines thereon.

15. The game apparatus of claim 14, wherein said straight grid lines comprise recessed grooves formed in said game board, and wherein said straight fence pieces each comprise at least one downwardly extending ridge portion for engaging said recessed grooves so as to hold said fence pieces in position on said game board.

16. The game apparatus of claim 14, further comprising:

means for selectively dividing said confined playing area into two or more adjacent secondary playing areas for use by competing players.

17. The game apparatus of claim 16, wherein said means for dividing said confined playing area into secondary playing areas comprises:

at least one elongate divider piece for being placed on said grid pattern.

18. The game apparatus of claim 17, wherein said grid pattern further comprises a pattern of straight, secondary grid lines, and wherein said at least one divider piece comprises an elongate, straight divider piece for being placed on said game board in alignment with said secondary grid lines thereon.

19. The game apparatus of claim 18, wherein said secondary grid lines comprise recessed grooves formed in said game board, and wherein said at least one divider piece comprises at least one downwardly extending ridge portion for engaging said recessed grooves so as to hold said divider piece in position on said game board.

20. The game apparatus of claim 18, wherein said at least one divider piece comprises:

a plurality of elongate, straight divider pieces for selectively dividing said confined playing area into a quadrant pattern comprising four secondary playing areas for use by competing players.

21. The game apparatus of claim 13, further comprising:

at least one riser piece having a thickness equal to a single level of said playing pieces, for being placed on said game board between said fence pieces so as to form a plurality of ascending levels within said confined playing area.

22. The game apparatus of claim 11, further comprising:

at least one tower piece for being selectively placed on said grid area, said tower piece having a height equal to a plurality of said levels of said playing pieces and bearing at least one of said indicia on said segments of said playing pieces so as to permit a segment having matching indicia to be played atop said tower piece.

23. The game apparatus of claim 22, wherein said at least one tower piece bears secondary indicia indicating an additional move to be made by a player when a matching segment is played atop said tower piece.

24. A game apparatus, comprising:

a plurality of elongate, rectangular, stepped playing pieces;

each said playing piece having thickness of first and second levels as newed from a side and comprising three substantially square, equal-sized segments arranged in a row so that when viewed from a top side said piece is one segment wide and three segments long;

said segments being distinguished by a binary set of indicia on said top sides thereof, so that playing pieces are stackable in play so that either first or second indicia match on each segment of upper and lower pieces that are in contact with one another.

25. The game apparatus of claim 24, wherein said binary indicia comprises:

a first dot pattern comprising a single dot located centrally on upper surfaces of said segments; and a second dot pattern comprising four dots arranged in a square on upper surfaces of said segments.

26. A game apparatus, comprising:

a plurality of tile-shaped playing pieces, each said playing piece being elongate and having at least three segments in lengthwise arrangement along a long axis said piece, each of said segments having a matching shape so that segments of said pieces are individually superimposable upon one another;

said segments of at least some of said playing pieces being distinguished by at least first and second indicia;

at least some of said playing pieces having differing stepped configurations such that some of said segments thereof have a two-level thickness and other segments thereof have a one-level thickness so as to form overhanging or underlying portions of said playing pieces, so that said playing pieces are stackable in play with indicia that match on each segment of upper and lower pieces that are in contact with one another;

a game board having a grid pattern formed thereon for aligning placement of said playing pieces;

means for defining a confined playing area on said grid pattern for placement of said playing pieces therein, said means for defining a confined playing area on said grid pattern comprising:

a plurality of elongate fence pieces for being placed in alignment with said grid pattern so as to selectively define confined playing areas of varying size; and at least one riser piece having a thickness equal to a single level of said playing pieces, for being placed on said game board between said fence pieces so as to form a plurality of ascending levels within said confined playing area.

27. The game apparatus of claim 26, further comprising:

at least one tower piece for being selectively placed on said grid area, said tower piece having a height equal to a plurality of said levels of said playing pieces and bearing at least one of said indicia on said segments of said playing pieces so as to permit a segment having matching indicia to be played atop said tower piece.

28. The game apparatus of claim 27, wherein said at least one tower piece bears secondary indicia indicating an additional move to be made by a player when a matching segment is played atop said tower piece.

* * * * *